United States Patent [19]

Morang

[11] 4,158,281

[45] * Jun. 19, 1979

[54] SPLICING TOOL

[75] Inventor: Frank L. Morang, St. Petersburg, Fla.

[73] Assignees: Harman Wheeler; M.W.W., Inc., both of St. Petersburgh, Fla.; part interest to each

[ * ] Notice: The portion of the term of this patent subsequent to Feb. 19, 1994, has been disclaimed.

[21] Appl. No.: 591,514

[22] Filed: Jun. 30, 1975

[51] Int. Cl.[2] ..... B65H 69/06

[52] U.S. Cl. ..... 57/23

[58] Field of Search ..... 57/22, 23, 159

[56] References Cited

U.S. PATENT DOCUMENTS

| | | | |
|---|---|---|---|
| 1,534,926 | 4/1925 | Doble | 57/23 |
| 2,351,402 | 6/1944 | Clark | 57/23 X |
| 3,097,474 | 7/1963 | Rohdenburg | 57/23 |

*Primary Examiner*—John Petrakes

*Attorney, Agent, or Firm*—Stein & Frijouf

[57] ABSTRACT

A splicing tool in the form of a fid structure designed primarily for splicing portions of a braided rope wherein the fid structure includes an outer casing having a substantially inner hollow portion in which a plug element is mounted. A grasping assembly in the form of a shaft and a grasp element attached thereto serves to fixedly engage one end of the rope portion being spliced wherein the grasping assembly is movable into and out of the interior of said fid in such a manner as to draw the grasp element into penetration with the connected end of the rope portion and maintain the rope portion in fixed engagement therewith due to the interior disposition of the grasp element within the fid structure.

6 Claims, 15 Drawing Figures

FIG. 1
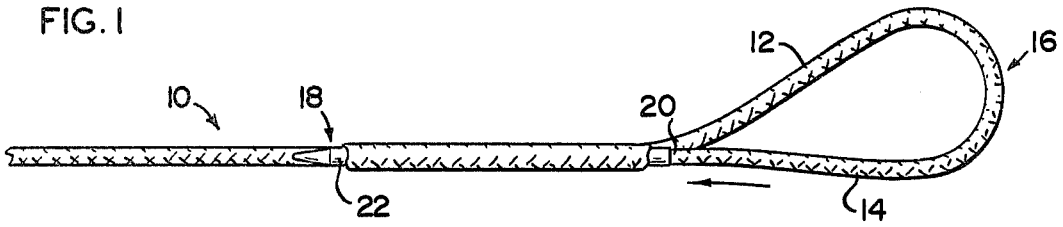
FIG. 2
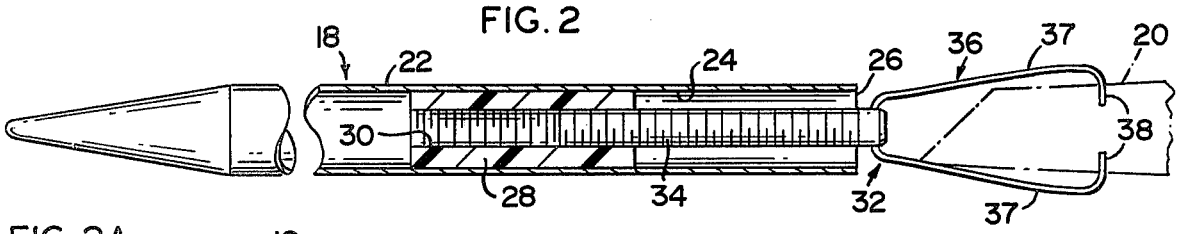
FIG. 2A
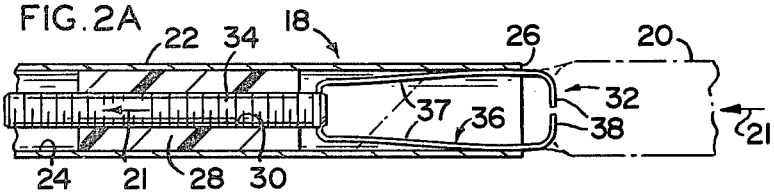
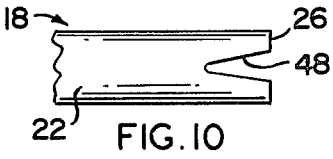
FIG. 10
FIG. 3
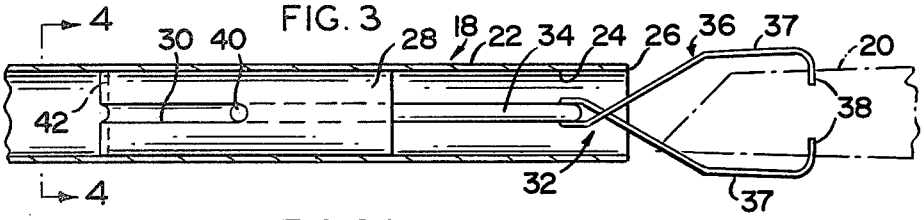
FIG. 4
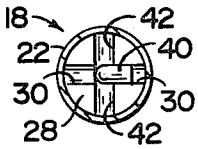
FIG. 3A
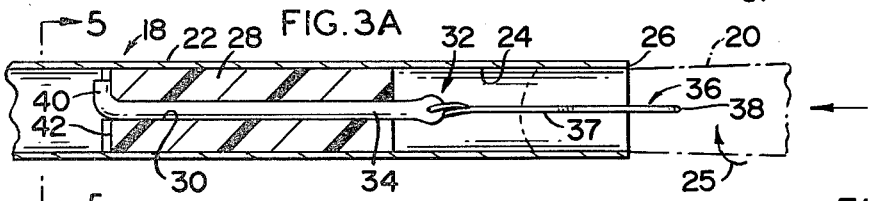
FIG. 5
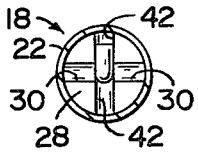
FIG. 6
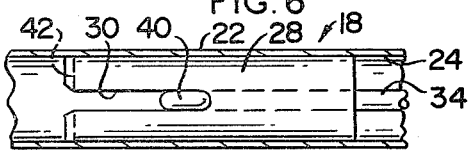
FIG. 6A
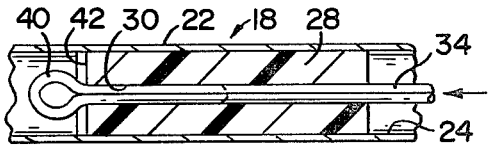
FIG. 7
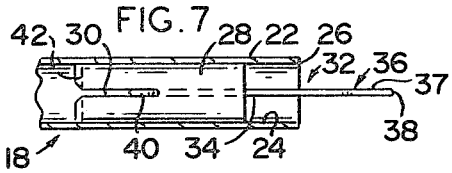
FIG. 8
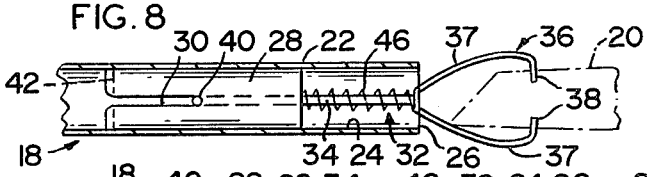
FIG. 7A
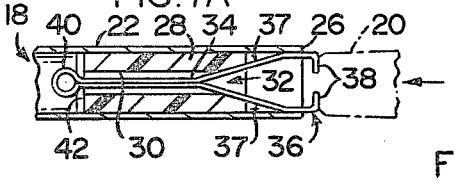
FIG. 8A
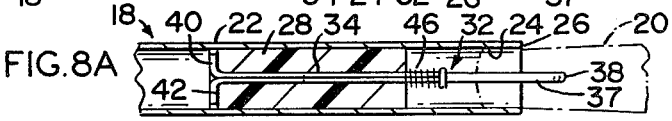
FIG. 9
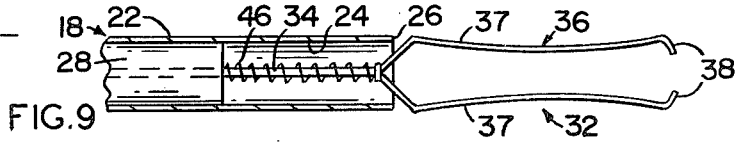

SPLICING TOOL

BACKGROUND OF THE INVENTION

1. Field of the Invention

This invention relates to a fid structure including a grasping assembly for securing the end of a rope portion being spliced directly to the end or interior portion thereof to facilitate splicing of end portions by proper positioning of the fid relative to the various rope portions being spliced.

2. Description of the Prior Art

Splicing tools for ropes of various structures have been utilized for many years. Such splicing tools take the form of needles or fid structures wherein the fid structure actually enters the interior of one of the rope portions being spliced. Alternately, splicing may occur through use of the fid or needle structures by braiding various rope portions together in a well-recognized fashion.

One particular application for conventional or prior art fid structures is the splicing of braided rope. Commonly, braided rope comprises a braided center or core and a braided cover portion disposed in surrounding relation thereto. Such a rope structure is produced by Samson Cordage Works of Boston, Mass. In splicing such a rope structure, it is common to use a fid structure having a substantially elongated configuration and a hollow interior.

In operation, the fid structure enters the cover and travels along the center or core a predetermined length. The open end exposing the hollow interior is left exposed and the end of the rope portion being braided is forced into the open end and into the interior of the fid through a push rod or push tool so that the end of the rope portion being spliced can properly be positioned on the interior of the cover as desired.

While such a structure is functional, certain obvious disadvantages are apparent.

In addition to this type of splicing tool used with braided rope, there are numerous other types of needles and/or fid structures designed for use with braided, or other similar structured rope of known design.

Such structures are represented in the following U.S. patents: U.S. Pat. Nos. Floyd, 782,120; Weed, 299,302; Fisher, 92,296; Helgesson, 535,108; Squire, 1,058,917; and Doble, 1,534,926.

Particularly, the patent to Doble shows a needle or fid structure wherein the rope portion being braided is attached to a grasping assembly which serves to connect the rope portion to the needle end wherein the needle can be readily manipulated. With this type of structure, the push rod, referred to above with regard to the splicing of Samsom cord can be eliminated. However, the Doble structure is representative of certain prior art devices which, for certain applications, are overly complex and less then efficient.

In any type of fid structure or marine needle used to splice ropes and like cordage, it is important that a secure grasping of the designated end portion of the rope being spliced is accomplished. At the same time, the structure should be capable of a minimal amount of manipulation to accomplish this secure engagement. The structural components of such a desired fid should require minimal maintenance so as to eliminate the possibility of breakdown and also reduce the initial cost of production.

SUMMARY OF THE INVENTION

This invention relates to a splicing tool in the form of a fid structure having an outer casing in the form of an elongated smooth surface needle. The casing has at least a portion thereof defining a substantially hollow configuration wherein one end of the casing is open and in communicating relation with the hollow portion of the interior. Grasping means including an elongated shaft is movably mounted on the interior of the fid in both a longitudinal and rotational direction relative to its own longitudinal axis.

More specifically, plug means having a substantially centrally located channel extending at least a portion of the way therethrough, is fixedly disposed on the interior of the fid. The plug means serves to engage the outer surface of the shaft of the grasping means. Depending upon the particular embodiment of the present invention utilized, either longitudinal and/or rotational movement of the shaft causes disposition of the grasping means into or out of the interior portion of the fid.

The main function of the grasping means is to securely engage one end of a rope portion being spliced. Accordingly, the grasping means comprises a grasp element in the form of a wire spring member having an inherent flexibility and bias and is specifically configured to define grasping teeth at each of the oppositely disposed ends of the spring member. These ends are configured to extend inwardly toward one another and further configured as projections to actually penetrate and/or grasp beyond the outer surface of the end of the rope portion to which the fid is connected.

Therefore, through movement of the shaft and attached grasp element longitudinally relative to the plug means and into the interior of the fid, the oppositely disposed arm portions which serve to define the configuration of the grasp element, are drawn inwardly. This in turn forces the grasping teeth or projecting extremities of the grasp element in toward one another so as to penetrate the end portion of the rope being spliced. The teeth are maintained in this locked engaged position relative to the rope end portion and the rope end portion itself is drawn into the interior of the fid through the open end referred to above.

Dependent upon the particular embodiment of the subject invention utilized, the shaft may be threadedly engaged within the channel of the plug means or alternately may be slidingly engaged therein to accomplish both a longitudinal and rotational movement relative thereto. The shaft may be fixedly attached in a predetermined disposition relative to the plug means by a shaft locking means. In one embodiment of the present invention the locking means itself may comprise the threaded engagement between the exterior channel surface and the exterior surface of the shaft. Alternately, the shaft locking means may comprise a head seat wherein the shaft may include an enlarged head portion wherein this head portion may be rotated out of the plane of the channel and into a head seat in the form of a groove wherein longitudinal movement of the shaft relative to the plug means is prevented until the head means and the channel are aligned.

Other embodiments of the present invention comprise the provisions of a biasing means disposed between the plug means and the grasping means itself wherein the grasping means is normally biased out of the open end of the interior of the fid. Longitudinal movement of the shaft and the grasping means into the interior of the fid moves the grasping means against the biasing means and maintains it in this forced biased position once the head of the shaft is disposed in its locked position.

Yet another embodiment of the present invention comprises the grasp element and shaft being formed into an integral one piece unit to facilitate simple structure and design and reduce the possibility of breakage, etc.

The invention accordingly comprises the features of construction, combination of elements and arrangement of parts which will be exemplified in the construction hereinafter set forth and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which:

FIG. 1 is a front view of the splicing tool of the present invention disposed for splicing designated rope portions of a braided rope.

FIG. 2 is a cutaway view in partial section showing the interior of the fid structure and the mounting means for the grasping means on the interior thereof.

FIG. 2A is a detailed sectional view showing disposition of the grasping means on the interior of the fid structure in fixed engagement with a rope end portion being spliced.

FIGS. 3 and 3A are partial cutaway, sectional views showing disposition of the grasping means relative to the interior of the fid structure and the rope end being spliced.

FIG. 4 is a sectional end view taken along line 4—4 of FIG. 3 showing the locking means of the present invention.

FIG. 5 is a sectional end view taken along line 5—5 of FIG. 3A also showing a different disposition of the shaft relative to the locking means of the present invention.

FIG. 6 is a detailed sectional view in partial cutaway showing another embodiment of the grasping means of the present invention.

FIG. 6A is a sectional view in partial cutaway showing the locked disposition of the shaft of the embodiment of FIG. 6.

FIGS. 7 and 7A are sectional views showing another embodiment of the shaft of the grasping means in its unlocked and locked position relative to a rope end being spliced respectively.

FIGS. 8 and 8A show yet another embodiment of the present invention in both its unlocked and locked position.

FIG. 9 shows yet another embodiment of the present invention wherein a biasing member is fixed in interconnecting relation between the plug means and the grasping means.

FIG. 10 shows one embodiment of the present invention directed to a specific configuration of the open end of the fid structure designed to accomplish predetermined dispositioning of the grasp element of the grasping means of the present invention.

Similar reference characters refer to similar parts throughout the several views of the drawings.

DETAILED DESCRIPTION

FIG. 1 shows a braided rope generally indicated as 10 having rope portions 12 and 14 which are to be spliced to one another to form loop portion 16 at the end thereof. To accomplish this, the splicing tool of the present invention includes a fid structure generally indicated as 18 in FIG. 2 which has one end 20 of rope portion 14 attached to the fid structure 18 as shown.

More specifically, the fid structure 18 comprises an outer casing 22 being substantially elongated and of predetermined length depending upon the particular use intended. The diameter or transverse dimension of the casing is dependent upon the size of the particular rope 10 being spliced.

The casing 22 of fid structure 18 has a hollow portion 24 formed on its interior and at least one of its ends being opened as at 26. Plug means 28 is fixedly attached on the interior of the casing 22 and comprises a channel means 30 extending at least partially the way therethrough.

Grasping means generally indicated as 32 comprises a shaft 34 and a grasp element 36 in the form of a wire spring member. The opposite extremities of the spring member 36 comprise oppositely disposed gripping teeth or projections 38 structured and configured so as to allow penetration of the extremities into the end of a rope portion 20 being spliced. In this capacity, the projections 38 may be defined as gripping teeth. Further, the inherent resiliency and bias formed in the spring member 36 allows relative movement of the portions 37 of the spring member 36 towards and away from one another. With reference to FIGS. 2 and 2A, FIG. 2 represents the unlocked position of the grasping means in that portions 37 of the spring member 36 are not maintained in a closed, fixed engagement with end 20 of rope portion 14. However, as the shaft 34 of the grasping means 32 moves inward into casing 22 as indicated by arrow 21, the portions 37 abut the inner surfaces of the open end 26 causing an inward movement relative to one another and a penetration of the gripping teeth 38 into the end 20 of rope portion 14.

Different embodiments of the present invention include first of all the embodiment of FIGS. 2 and 2A wherein the exterior shaft surface 34 threadedly engages the threaded surface of channel 30. Accordingly, rotation of the shaft 34 and accordingly the grip element 36 causes inward movement of the gripping means 32 in the direction indicated by arrow 21 and the interaction of gripping teeth 38 on the rope end, as described above.

Yet another embodiment of the present invention is shown in FIGS. 3 and 3A wherein shaft 34 has an essentially smooth outer surface which slidingly engages the channel 30 of plug means 28. Further in this embodiment a head portion 40 is enlarged or configured to extend beyond channel 34 when rotated in a certain specific orientation in accordance with the directional arrow 25. Therefore, the inward and outward motion of the shaft 34 and channel 30 is caused by a longitudinal force being exerted thereon. A shaft locking means as shown in FIG. 4 comprises a head seat 42 in the form of a transverse or offset groove relative to the channel 30. In this embodiment, and as shown in FIG. 5, the entire grasping means 32 is disposed in its locked position as shown in FIG. 3A by the shaft 34 being positioned within the interior of casing 22 and then rotating shaft 34 into its locked position as shown in FIGS. 3A and 5. The configuration and dimension of the head portion 40 is disposed to fit within the head seat 42 thereby preventing its longitudinal displacement back along the channel 30 and out of the interior of casing 22. Yet another embodiment of the present invention is shown in FIGS. 6 and 6A wherein the head portion 40 is integrally formed with the shaft 34 and the shaft itself 34 may comprise a double bodied structure as clearly shown in FIG. 6A. This embodiment operates similar to that embodiment shown in FIGS. 3 and 3A and that a rotation of the head portion into a groove comprising the head seat 42 prevents the outward longitudinal motion of the valve 34 and maintains it in a locked position so as to further maintain the teeth 38 in a fixed penetrating relation relative to the end 20 of rope 14. FIGS. 7 and 7A show a modification of the embodiment of FIGS. 6 and 6A wherein the grasping means including portions 37 are integrally attached to the shaft 34 and the head 40. In this embodiment also, the grasp element including the grasping teeth 38 operate in the same manner and are further integrally attached to the one piece grasping means generally indicated as 36.

Yet another embodiment of the present invention (FIGS. 8, 8A and 9) comprises the inclusion of a biasing means in the form of a spring element 46 interconnected between plug means 28 and the grasping means 36 itself. The disposition of the biasing spring 46 is such as to normally bias the grasp element out of the open end 26 from the interior of the casing 22.

Yet another embodiment of the present invention (FIG. 10) comprises a dove-tail configuration generally indicated as 48 configured and integrally formed on the open end 26 of the casing 22. This serves to hold and orient the portions 37 and the basis of the grasp element 36 into a desired open or closed relationship to the rope end 20 as it enters and is fixed relative to the interior and end portion 26 of the casing 22.

While the preferred embodiment has been described with reference to use with a braided rope having an inner core and an outer braided cover, it is readily seen that the scope of the present invention is intended to cover all types of structured ropes wherein splicing can readily be accomplished through the attachment of one end of the rope portion to be spliced to the end portion of the fid structure as clearly indicated in FIGS. 1, 2 and 2A.

It will thus be seen that the objects set forth above, among those made apparent from the preceding description, are efficiently attained, and since certain changes may be made in carrying out the above method and article without departing from the scope of the invention, it is intended that all matter contained in the above description shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described, what is claimed is:

1. A splicing tool primarily designed for splicing rope portions, said splicing tool comprising: a fid element including a substantially hollow portion and at least one open end disposed in communicating relation with said hollow portion, plug means mounted on the interior of said fid element, grasping means including a shaft movably connected to said plug means, said grasping means further including a grasp element connected to said shaft so as to move along therewith, said grasping means disposed for movement longitudinally of said plug means into and out of said fid element, said grasp element comprising a one piece wire spring member structurally configured to comprise inherent bias, whereby movement of said grasp element into and out of said fid element causes relative movement of corresponding portions of said wire spring member towards and away from one another respectively, gripping teeth means defined by the extremities of said wire spring member, said gripping teeth means defined by projections, whereby said gripping teeth projections serve to penetrate a rope portion being spliced; said plug means comprising a channel formed therein and including a reduced diameter relative to that of said fid element, said shaft being disposed in sliding engagement within said channel for both relative longitudinal and rotational movement therein, said shaft further comprising a head portion configured to extend outwardly from the longitudinal axis of said shaft, said channel configured for sliding engagement relative to said head portion therein, whereby said head portion may move along the interior of said channel along the longitudinal axis thereof.

2. A splicing tool primarily designed for splicing rope portions, said splicing tool comprising: a fid element including a substantially hollow portion and at least one open end disposed in communicating relation with said hollow portion, plug means mounted on the interior of said fid element, grasping means including a shaft movably connected to said plug means, said grasping means further including a grasp element connected to said shaft so as to move along therewith, said grasping means disposed for movement longitudinally of said plug means into and out of said fid element, said grasp element comprising a one piece wire spring member structurally configured to comprise inherent bias, whereby movement of said grasp element into and out of said fid element causes relative movement of corresponding portions of said wire spring member towards and away from one another respectively, gripping teeth means defined by perpendicular bends proximate the extremities of said wire spring member, said gripping teeth means extending substantially perpendicular to the longitudinal axis of said fid element whereby said gripping teeth projections serve to penetrate a rope portion being spliced; said plug means comprising a channel formed therein, said channel including a reduced diameter relative to that of said fid element, said shaft movably being mounted within said channel and disposed for movement in both a longitudinal and rotational direction relative to the longitudinal axis of said plug means; said shaft being disposed in threaded engagement within said channel for both longitudinal and rotational movement within said fid element.

3. A splicing tool as in claim 1 further comprising shaft lock means formed on said plug means in engageable relation to said head portion, said lock means disposed in offset relation to said channel, whereby rotational orientation of shaft and said head portion relative to the longitudinal axis of said plug means serves to orient said shaft and said shaft lock means.

4. A splicing tool as in claim 3 wherein said shaft lock means comprises a head seat integrally formed on said plug means in offset relation to the channel in said plug means.

5. A splicing tool as in claim 1 wherein said shaft and said grasp element are formed into an integral one piece unit, said grasp element comprising an inherent fexibility, whereby oppositely disposed extremities of said grasp element are movable relative to one another.

6. A splicing tool as in claim 1 further comprising biased means including a spring element positioned in interconnecting relation between said plug means and said grasping means and disposed to normally bias said grasping means away from said plug and out of the open end of said fid structure.

* * * * *